United States Patent [19]

Sandler

[11] Patent Number: 5,074,351

[45] Date of Patent: Dec. 24, 1991

[54] VENETIAN BLIND RESTRAINING DEVICE

[76] Inventor: Samuel Sandler, 71 Woodford Cres., S.W., Calgary, Alberta, Canada, T2W 4C6

[21] Appl. No.: 533,377

[22] Filed: Jun. 5, 1990

[51] Int. Cl.[5] ..... E06B 9/30

[52] U.S. Cl. ..... 160/178.1; 160/349.1; 248/316.4

[58] Field of Search ..... 160/178.1, 349.2, 349.1, 160/166.1, 172; 248/297.5, 297.3, 316.4, 231.4; 211/43

[56] References Cited

U.S. PATENT DOCUMENTS

| | | | |
|---|---|---|---|
| 2,507,690 | 5/1950 | Burns | 160/172 |
| 2,517,927 | 8/1950 | Reed | 248/231.4 X |
| 3,544,049 | 1/1970 | Brown et al. | 248/231.4 X |

*Primary Examiner*—Blair M. Johnson

*Attorney, Agent, or Firm*—George A. Seaby

[57] ABSTRACT

A relatively simple device for preventing rattling of venetian blind slats includes an L-shaped bracket for mounting on a wall or window frame proximate one end of the blind, and a pair of baffle plates slidable on the bracket for sandwiching the slats in a fixed position to prevent rattling thereof.

1 Claim, 1 Drawing Sheet

VENETIAN BLIND RESTRAINING DEVICE

BACKGROUND OF THE INVENTION

1. Field of the Invention

This invention relates to a venetian blind restraining device.

More specifically, the invention relates to a device for limiting vibration of the slats of a venetian blind to reduce or eliminate rattling.

2. Discussion of the Prior Art

In general, venetian blinds consist of a plurality of thin, elongated slats, which are usually formed of metal, and which are interconnected by strings at both ends thereof. An annoying problem with such blinds is that of rattling, i.e. when in anything but a slight breeze, the slats will vibrate, rattling together. The only existing commercially available devices for dealing with this problem are attached to the bottom of the blinds for preventing movement of the entire blinds in a heavy wind. The inventor is aware of no available devices for preventing rattling of the individual slats.

OBJECT OF THE INVENTION

The object of the present invention is to solve the above described problem by providing a relatively simple restraining device, which eliminates or substantially reduces rattling of a venetian blind in a breeze.

GENERAL DESCRIPTION OF THE INVENTION

Accordingly, the present invention relates to a device for restraining a venetian blind comprising bracket means for mounting on a support surface proximate one end of a blind; and a pair of baffle plate means for mounting on said bracket means in overlapping relationship with the ends of a plurality of the slats of a blind, whereby, when sandwiched between said plate means, vibration of the slats is prevented or substantially reduced.

BRIEF DESCRIPTION OF DRAWINGS

The invention will be described in greater detail with reference to the accompanying drawings, which illustrate a preferred of the invention, and wherein.

DESCRIPTION OF PREFERRED EMBODIMENT

Figure 1:
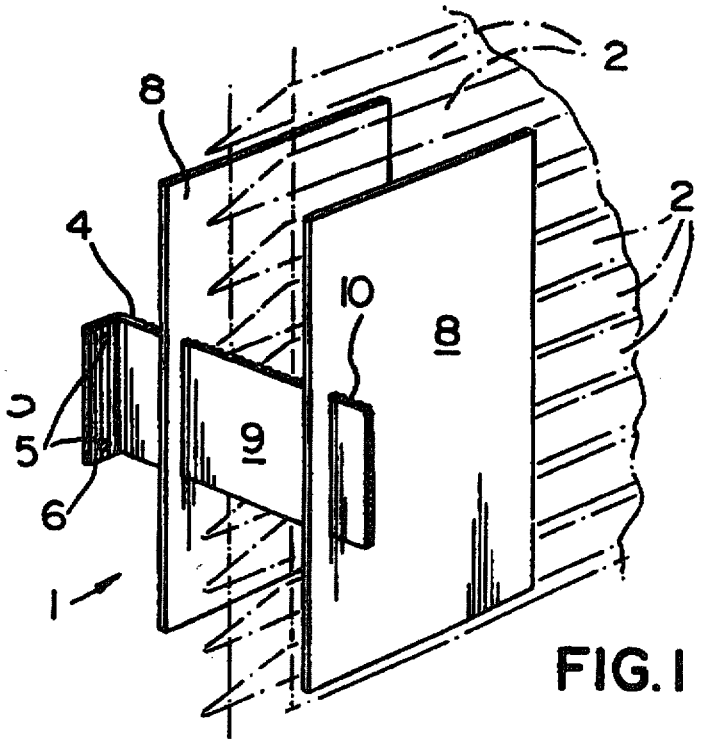
FIG. 1 is a schematic, isometric view of a device in accordance with the present invention and a portion of one end of a venetian blind.
Figure 2:
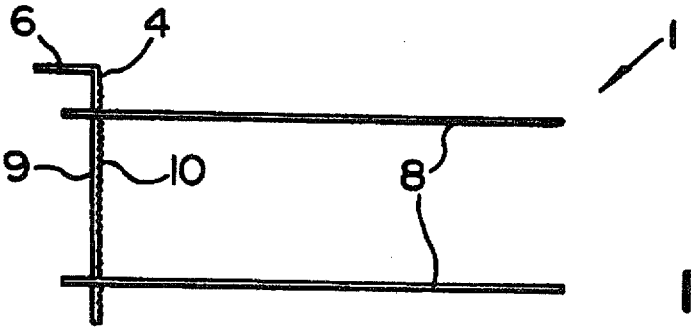
FIG. 2 is a plan view of the device of FIG. 1.
Figure 3:
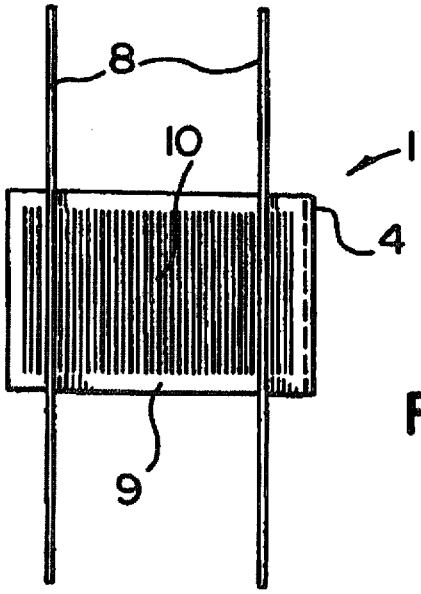
FIG. 3 is an end view of the device of FIGS. 1 and 2, as seen from the right of FIG. 2.

With reference to the drawings, the device of the present invention which is generally indicated at 1 is intended for use with a venetian blind of the type including a plurality of parallel, horizontal slats 2 interconnected at each end by strings 3 (one shown). As mentioned above, the slats 2 are in the form of thin metal strips which will rattle together in even a light breeze.

The device 1 includes a generally L-shaped bracket 4. Holes 5 are provided in one short arm 6 of the bracket 4 for receiving screws or nails (not shown) for mounting the bracket on a wall or window frame adjacent one end of a blind. A pair of elongated, rectangular baffle plates 8 are slidably mounted on the longer, outwardly extending arm 9 of the bracket 4. Movement of the plates 8 is restricted by alternating ridges and grooves 10, which normally retain the plates 8 in one position, but permit sliding of the plates toward and away from each other.

In use, a bracket 4 is mounted on one side of a venetian blind with the plates 8 on each side of one end of a plurality of slats 2 of the blind. One or more devices 1 can be mounted at both ends of the blind. The baffle plates 8 are moved together to positions where they press against the slats 2, hindering or preventing vibration of the slats. Thus, except under exceptional conditions, rattling of the slats together is prevented.

Thus, there has been described a relatively simple restraining device, which eliminates or substantially reduces annoying rattling of venetian blinds.

I claim:

1. A device for restraining a venetian blind comprising a pair of baffle plate means of sufficient length to simultaneously overlap the ends of a plurality of slats of the blind; L-shaped bracket means including a first arm for mounting the device on a support surface proximate one end of a blind, a second arm extending outwardly from the first arm, each of said baffle plate means having a slot sized to be closely engaged by said second arm, said baffle plate means having a plurality of alternating ridges and grooves on one side of said second arm, wherein, said baffle plate means engages said second arm so as to be adjustably held at a given position therealong by mating with said ridges and grooves for releasably retaining said plate means in fixed positions, whereby, when said slats are sandwiched between the plate means, vibration of the slats is prevented or substantially reduced.

* * * * *